US007670021B2

(12) United States Patent
Chou

(10) Patent No.: US 7,670,021 B2
(45) Date of Patent: Mar. 2, 2010

(54) METHOD AND APPARATUS FOR THERMALLY EFFECTIVE TRIM FOR LIGHT FIXTURE

(75) Inventor: Der Jeou Chou, Mesa, AZ (US)

(73) Assignee: Enertron, Inc., Tempe, AZ (US)

( * ) Notice: Subject to any disclaimer, the term of this patent is extended or adjusted under 35 U.S.C. 154(b) by 1 day.

(21) Appl. No.: 12/123,960

(22) Filed: May 20, 2008

(65) Prior Publication Data

US 2009/0086474 A1 Apr. 2, 2009

Related U.S. Application Data

(60) Provisional application No. 60/975,657, filed on Sep. 27, 2007.

(51) Int. Cl.
*F21V 29/00* (2006.01)

(52) U.S. Cl. ..... 362/148; 362/147; 362/404; 362/294

(58) Field of Classification Search ..... 362/147, 362/148, 149, 150, 404, 294, 373, 547
See application file for complete search history.

(56) References Cited

U.S. PATENT DOCUMENTS

| | | | |
|---|---|---|---|
| 4,211,955 | A | 7/1980 | Ray |
| 4,499,145 | A | 2/1985 | Yanagida et al. |
| 4,630,183 | A | 12/1986 | Fujita |
| 4,727,289 | A | 2/1988 | Uchida |
| 5,210,440 | A | 5/1993 | Long |
| 5,463,229 | A | 10/1995 | Takase et al. |
| 5,463,280 | A | 10/1995 | Johnson |
| 5,575,459 | A | 11/1996 | Anderson |
| 5,655,830 | A | 8/1997 | Ruskouski |
| 5,688,042 | A | 11/1997 | Madadi et al. |
| 5,698,866 | A | 12/1997 | Doiron et al. |
| 5,717,320 | A | 2/1998 | Heeringa et al. |
| 5,726,535 | A | 3/1998 | Yan |
| 6,149,283 | A | 11/2000 | Conway et al. |
| 6,220,722 | B1 | 4/2001 | Begemann |

(Continued)

FOREIGN PATENT DOCUMENTS

KR 2003-53853 7/2003

OTHER PUBLICATIONS

The New York Times, "L.E.D.'s Make for Warm Light But the Bulb Keeps Its Cool," Apr. 2004.

*Primary Examiner*—Laura Tso
(74) *Attorney, Agent, or Firm*—Robert D. Atkins

(57) ABSTRACT

A lighting assembly comprises a light fixture. The light fixture includes a trim formed by a stamping or die casting process. The trim has thermally conductive properties and includes a flange around a perimeter of the trim. The light fixture includes a light source mounted to a central portion of a front surface of the trim, and a heatsink formed by an extrusion or die casting process. The heatsink has thermally conductive properties and is mounted to a back surface of the trim. The light fixture includes an attachment mechanism connected to the light fixture. A recessed can housing mounted to a surface may be provided. The light fixture may be mounted to the recessed can housing by inserting the heatsink into the recessed can housing and engaging the attachment mechanism to an interior portion of the recessed can housing to brace the flange against the surface.

19 Claims, 11 Drawing Sheets

U.S. PATENT DOCUMENTS 6,234,649 B1 5/2001 Katougi
6,431,728 B1 8/2002 Fredericks et al.
6,441,558 B1 8/2002 Muthu et al.
6,481,130 B1 11/2002 Wu
6,499,860 B2 12/2002 Begemann
6,511,209 B1 * 1/2003 Chiang ..... 362/294
6,632,892 B2 10/2003 Rubinsztajn et al.
6,719,446 B2 4/2004 Cao
6,942,360 B2 9/2005 Chou et al.
2002/0070643 A1 6/2002 Yeh
2003/0048632 A1 3/2003 Archer
2003/0071366 A1 4/2003 Rubinsztajn et al.
2003/0189829 A1 10/2003 Shimizu et al.
2004/0066652 A1 4/2004 Hong
2004/0105264 A1 6/2004 Spero
2006/0239002 A1 10/2006 Chou et al.
2008/0037255 A1 * 2/2008 Wang ..... 362/294
2008/0089071 A1 * 4/2008 Wang ..... 362/294

* cited by examiner

METHOD AND APPARATUS FOR THERMALLY EFFECTIVE TRIM FOR LIGHT FIXTURE

CLAIM TO DOMESTIC PRIORITY

The present non-provisional patent application claims priority to Provisional Application No. 60/975,657 entitled "Thermally Effective Trim for LED Light in Recessed Can Fixture Applications," filed on Sep. 27, 2007, and claims priority to the foregoing application pursuant to 35 U.S.C. § 120.

FIELD OF THE INVENTION

The present invention relates in general to light emitting devices and, specifically, to a recessed light fixture having a thermally effective trim.

BACKGROUND OF THE INVENTION

Light emitting diodes (LEDs) have been used for decades in applications requiring relatively low-energy indicator lamps, numerical readouts, and the like. In recent years, however, the brightness and power of individual LEDs has increased substantially, resulting in the availability of 1 watt and 5 watt devices.

While small, LEDs exhibit a high efficacy and life expectancy as compared to traditional lighting products. A typical incandescent bulb has an efficacy of 10 to 12 lumens per watt, and lasts for about 1,000 to 2,000 hours; a general fluorescent bulb has an efficacy of 40 to 80 lumens per watt, and lasts for 10,000 to 20,000 hours; a typical halogen bulb has an efficacy of 20 lumens and lasts for 2,000 to 3,000 hours. In contrast, red-orange LEDs can emit 55 lumens per watt with a life-expectancy of about 100,000 hours.

Because LED devices generate heat, the use of LEDs or LED lamps in a recessed can fixture or housing can present problems due to the thermal constraints of LEDs—heat negatively affects the optical and electrical performance of LEDs. Because conventional recessed can applications tend to be thermally inefficient and do not provide adequate heat ventilation, an LED device installed into a recessed can housing will quickly generate substantial amounts of heat within the housing that can damage the device.

Presently, most of the recessed can housings for residential and commercial applications are fully sealed at the can top, which means there is no air passage from the can to the space above the housing. Also, in most cases, the thermal insulation in the attic is placed around the can further restricting the flow of heat out of the housing. As a result, there is no effective heat dissipation path from the can housing to the attic.

An LED-based lamp installed into a recessed can housing requires an effective heat dissipation path to operate and to maintain its optical and electrical performance, longevity and reliability. FIG. 1 is an illustration of an LED parabolic aluminized reflector (PAR) lamp with a conventional base socket that may be installed into a conventional recessed can housing. Although the fins on the lamp are designed for dispersing the heat generated from the LED light engine, the heat is captured within the housing and does not dissipate. Lab experiments show that the fin temperature of a 15 watt LED lamp operated under open air conditions generates a rise in fin temperature of 25° C. over ambient temperature. When the lamp is positioned flush with the lid of a recessed can housing there is a 45° C. rise over ambient air temperature in the housing. If the lamp is further recessed into the can 2.54 cm behind the can lid, the temperature increase is approximately 60° C. At the ceiling of a typical home the air temperature will be 40° C. in the summer. As a result, the LED die junction temperature inside the LED lamp may be over approximately 100° C. when the LED lamp is flush with the trim lid.

The recessed can is one of the most widely used light fixtures in modern homes in the United States. There are millions of incandescent light bulbs installed into recessed can fixtures. Successful retrofit of an LED lamp to the existing and new recessed can housings may result in an 80% decrease in lighting energy consumption and an increase of the lamp's operating life from a typical 2,000 hours incandescence to the 50,000 hours of an LED device.

SUMMARY OF THE INVENTION

In one embodiment, the present invention is a method of manufacturing a lighting assembly comprising providing a light fixture by (a) forming a trim by a stamping or die casting process. The trim has thermally conductive properties and includes a flange around a perimeter of the trim. Providing the light fixture includes (b) mounting a light source to a central portion of a front surface of the trim, and (c) forming a heatsink by an extrusion or die casting process. The heatsink has thermally conductive properties. Providing the light fixture includes (d) mounting the heatsink to a back surface of the trim opposite the light source, and (e) connecting an attachment mechanism to the light fixture. The method includes providing a recessed can housing mounted to a surface and mounting the light fixture to the recessed can housing by (f) inserting the heatsink into the recessed can housing, and (g) engaging the attachment mechanism to an interior portion of the recessed can housing to brace the flange against the surface.

In another embodiment, the present invention is a method of manufacturing a light fixture comprising forming a trim. The trim has thermally conductive properties and includes a flange around a perimeter of the trim. The method includes mounting a light source to a central portion of a front surface of the trim, and forming a heatsink. The heatsink has thermally conductive properties. The method includes mounting the heatsink to a back surface of the trim opposite the light source, and connecting an attachment mechanism to the light fixture.

In another embodiment, the present invention is a method of manufacturing a light fixture comprising forming a trim including a flange around a perimeter of the trim, mounting a light source to a front surface of the trim, mounting a heatsink to a back surface of the trim, and connecting an attachment mechanism to the light fixture.

In another embodiment, the present invention is a light fixture comprising a trim formed by a stamping or die casting process. The trim has thermally conductive properties and includes a flange around a perimeter of the trim. The light fixture includes a light source mounted to a central portion of a front surface of the trim, and a heatsink mounted to a back surface of the trim opposite the light source. The heatsink is formed by an extrusion or die casting process and has thermally conductive properties. The light fixture includes an attachment mechanism connected to the light fixture.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 2A:
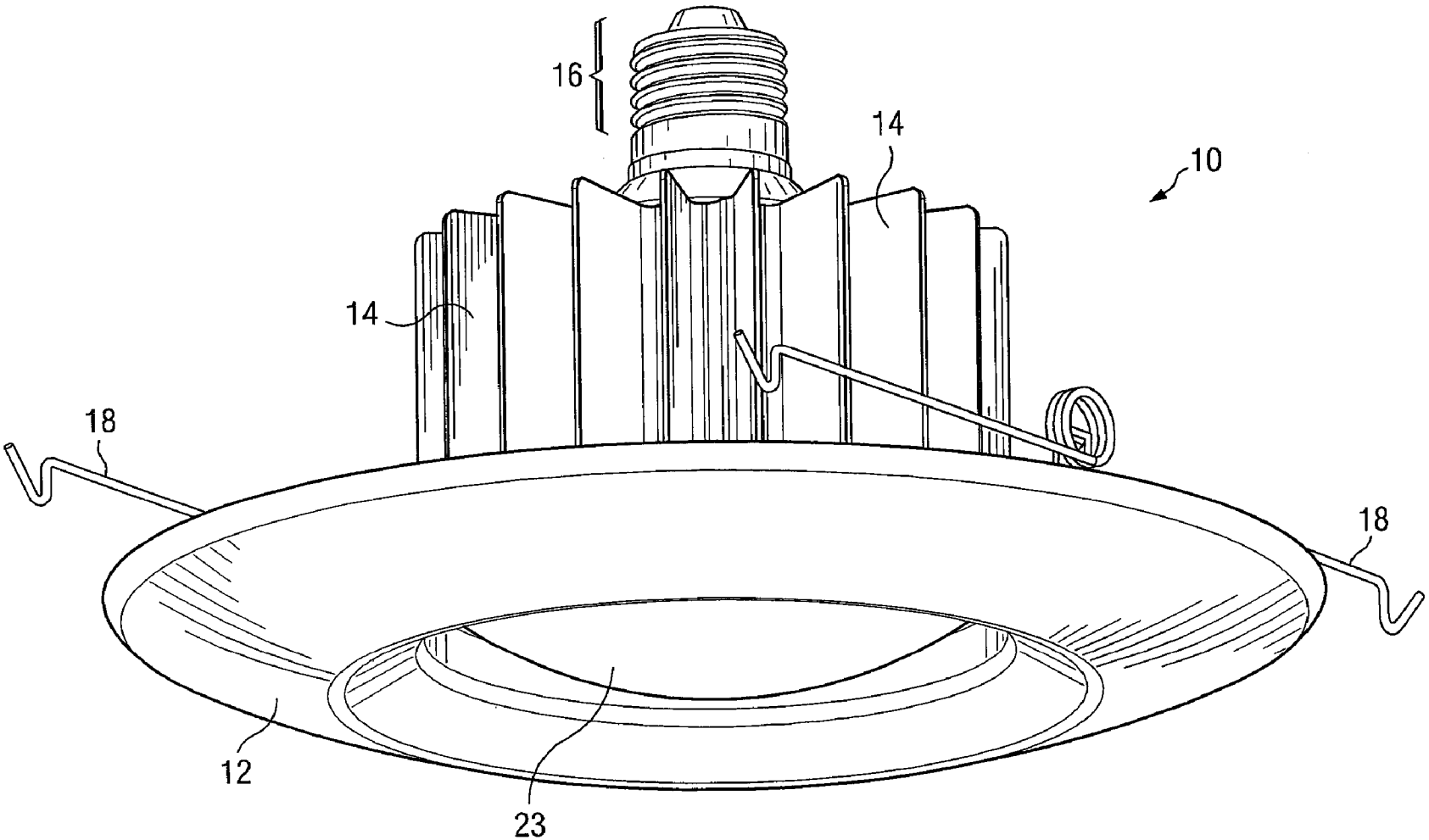
FIG. 2*a* illustrates a perspective view of a recessed can light fixture including a thermally conductive trim and heatsink for redistributing heat.
Figure 2B:
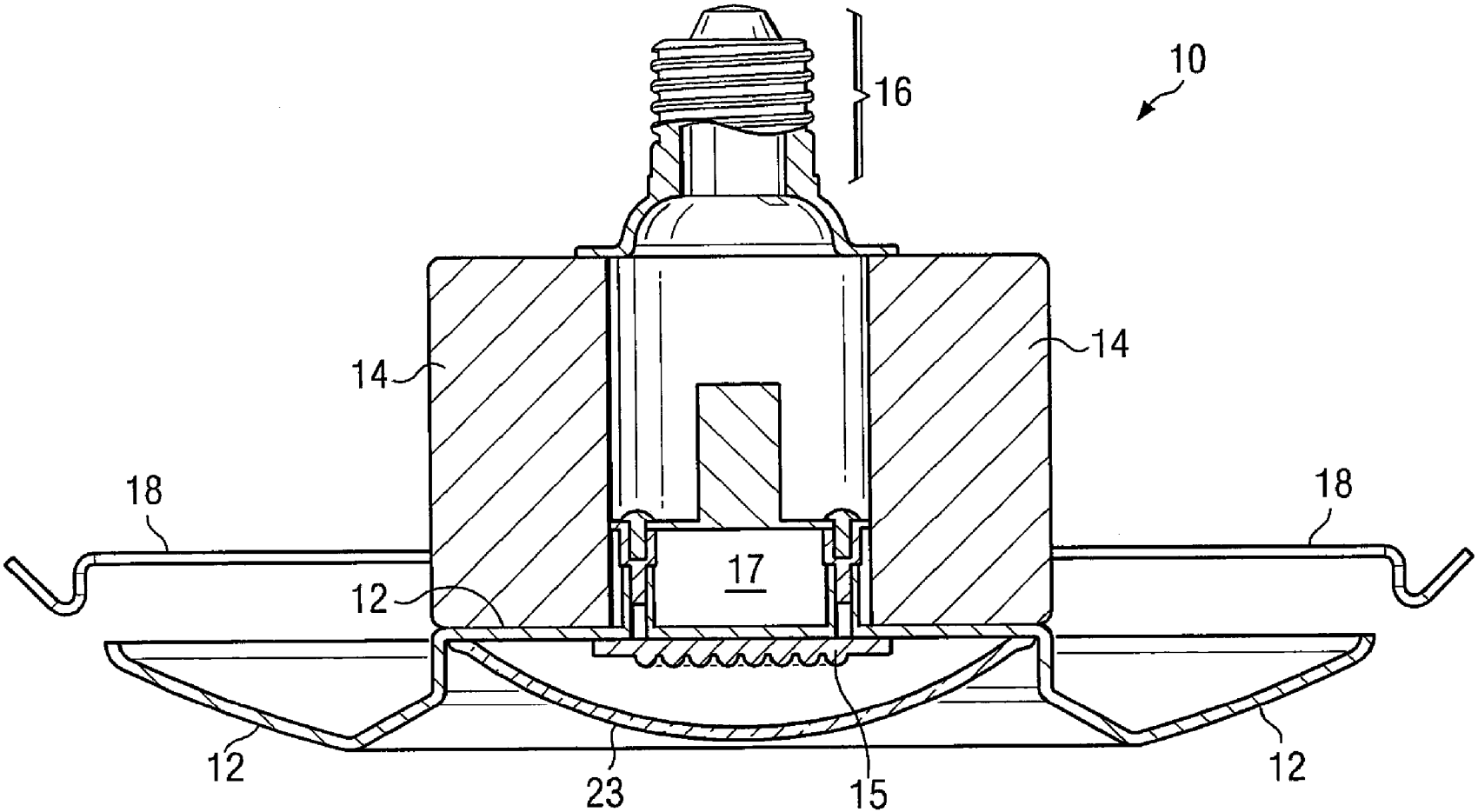
FIG. 2*b* illustrates a cross-sectional view of a recessed can light fixture including a thermally conductive trim and heatsink for redistributing heat.

FIGS. 2*a* and 2*b* illustrate recessed can fixture 10 housing a light source. FIG. 2*a* shows a perspective view of fixture 10, while FIG. 2*b* shows a cross-sectional view. Light fixture 10 is a thermally efficient structure that enables a heat-generating light source such as an LED lamp to safely operate in a typical top sealed recessed can housing. Although recessed light fixtures provide various aesthetic and architectural benefits to homeowners and businesses, they generally provide poor ventilation and, as a result, can cause a significant amount of heat build-up within the housing. In addition to the potential fire risk of excessive heat build-up, heat may negatively affect the performance of the light fixture itself.

Excessive heat minimizes the lifespan of both conventional light bulbs and LED light sources. In some cases, excessive heat also modifies the operating properties of a light source. For example, because the light generation properties of many LED light sources are at least partially governed by temperature, a significant change in the ambient temperature surrounding an LED light source may cause a change in the output color of light emitted from the device. Accordingly, a thermally efficient fixture minimizes both the risk of fire and the effect of temperature on the output color and lifespan of the light source contained within the fixture.

Fixture 10 is configured to install into both conventional 12.7 cm (5 inch) and 15.24 cm (6 inch) recessed can housings. However, fixture 10 may be configured to be installed into a recessed can housing having other geometries. Depending upon the installation, different attachment mechanisms may be used to secure fixture 10 within the housing. As new recessed housings are developed with different geometries, new attachment mechanisms with different lengths or other attributes can be manufactured for coupling to and installing fixture 10 into those housings.

Fixture 10 includes several components that are coupled together to provide efficient dissipation of heat energy from within the device. Fixture 10 includes trim 12. Trim 12 includes a flange that, after installation of fixture 10, protrudes from the recessed can housing. Heatsink 14 is coupled to trim 12 to facilitate the removal of heat energy from trim 12 and fixture 10. Light source 15 (shown on FIG. 2*b*) is directly mounted to a front surface of trim 12 and acts as the light source of the device. Fixture 10 includes an electrical socket 16 for connecting the light source to an electricity source. Socket 16 may include an E26/E27 bulb socket or a GU24 socket. Depending upon the application, the electricity source may be a standard 120 VAC, 220 VAC, 277 VAC, or other AC source or a DC power source. If the power source is an AC power source and the light source is configured to operate using a DC power source, an AC to DC converter circuit may be connected between socket 16 and the light source to convert the AC power source into a DC source. In one embodiment, the conversion circuit includes circuit board 17 mounted within heatsink 14. In such a configuration, heatsink 14 facilitates the removal of heat energy from both trim 12 and circuit board 17. Window or lens 23 is connected to trim 12 to form an output portal for light generated by light source 15. Attachment clips 18 are connected to fixture 10 and allow fixture 10 to be mounted within a recessed can housing. In one embodiment, clips or torsion springs 18 are connected to trim 12. The geometry of clips 18 is adjusted to install fixture 10 into recessed can housings having different sizes. Mounting brackets (not shown) configured for a particular recessed can housing may be connected between clips 18 and fixture 10 to adjust the placement of clips 18.

Figure 3:
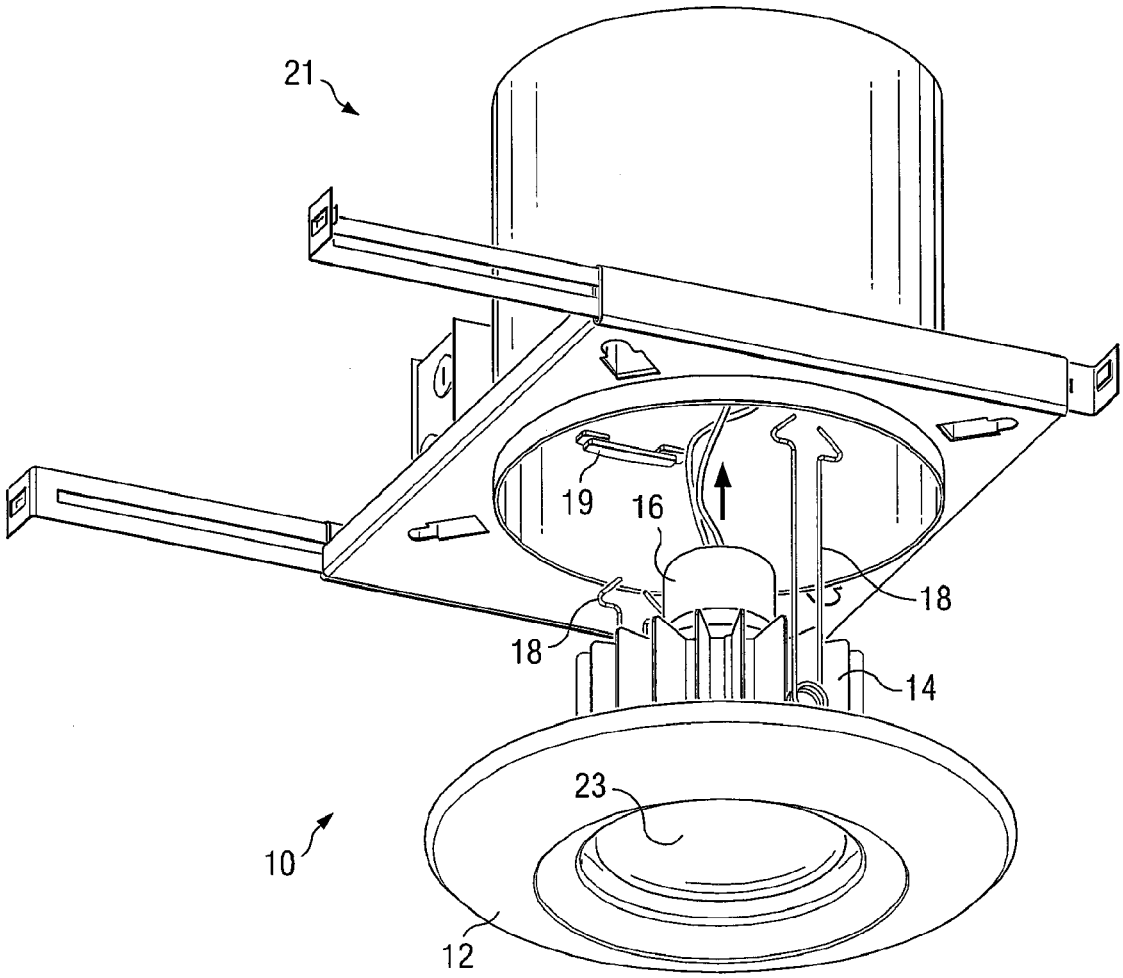
FIG. 3 is a perspective view illustrating the installation of the light fixture of FIGS. 2*a*-2*b* into a recessed can housing.

Turning to FIG. 3, fixture 10 is inserted into recessed can housing 21. Socket 16 is connected to an electricity source made available within recessed housing 21. Clips 18 are compressed and inserted into housing 21. After insertion, clips 18 expand and engage with apertures 19 fixed to the interior surface of the housing to secure fixture 10 within housing 21. After installation, heatsink 14 resides substantially within the housing and trim 12 resides substantially outside the housing. The outer flange of trim 12 may contact a structural surface that surrounds the recessed housing such as a ceiling or wall surface (not shown). As clips 18 expand and exert force against an interior surface of the recessed can housing (such as apertures 19), clips 18 exert force on fixture 10 and, specifically, pull the flange portion of trim 12 against the surface surrounding the recessed can application.

During operation, the light source generates heat. In a conventional recessed can fixture, the heat would ordinarily be generated by the light bulb and travel upwards within the housing. After leaving the light bulb, the heat is trapped in the recessed housing. As the device generates additional heat, the temperature within the housing increases and negatively affects the performance of the light fixture. In some cases, the excess heat shortens the operative lifetime of the device or degrades the optical qualities of the light source. In other cases, the excess heat may result in a fire risk. Typical incandescent recessed can fixtures require thermal cutoff devices to be connected in series with the incandescent lamp to prevent a fire risk when overheating.

In the present embodiment, however, as the light source operates, heat is transferred directly into trim 12 from the light source. As the temperature of trim 12 increases, heat is vented from the flange portion of trim 12 that resides outside the recessed can housing. Also, because trim 12 is connected to heatsink 14, a portion of the heat residing in trim 12 is transmitted into heatsink 14 where it is then vented within the recessed housing. Although some heat is vented into the recessed housing via heatsink 14, a majority of heat is dissipated from trim 12 outside the housing. Accordingly, fixture 10 minimizes heat build-up within the recessed housing.

In this configuration, heat energy flows from the light source, into trim 12, where a portion of the heat energy is dissipated from trim 12. Heat energy remaining in trim 12 is transferred into heatsink 14. As such, heatsink 14 may be regarded as acting as a heatsink for trim 12 rather than the light source directly.

Trim 12 and the flange of trim 12 generally dissipates more heat energy from the light source than heatsink 14. By doing so, trim 12 minimizes heat build-up within the recessed can housing. The following analysis describes an example installation of fixture 10 and illustrates a process for determining the ratio of energy dispersed from trim 12 versus heatsink 14. In the example, trim 12 includes a thermally conductive material such as aluminum, and has an outer diameter of 200 mm, an inner diameter of 130 mm and a depth of 42 mm (see FIG. 4*a*). Accordingly, trim 12 has an approximate surface area of $A_{trim}$=0.0296 $m^2$. To determine the percentage of heat dissipated by both trim 12 and heatsink 14 the convection heat transfer and radiation heat transfer for each component must be determined.

Convection heat transfer ($Q_{conv}$) for trim 12 is shown by equation (1):

$$Q_{conv}=\eta h A_{trim} dT \quad (1)$$

where

η: trim efficiency;

h: convection heat transfer coefficient (W/° C.-$m^2$), typical free convection coefficient=5, plus approximated radiation effect of 5, giving a total estimated value of 10; and dT: temperature difference between the trim and the ambient air (° C.).

In equation (1), η=tan h mL/mL where $mL=(h/(k*t*L))^{1/2}*L^{3/2}$. Accordingly, $mL=(10/(180\times0.002\times0.064))^{1/2}\times0.064^{3/2}$ or 0.33. As such, η=tan h 0.33/0.33=0.965.

Radiation heat transfer for trim 12 is shown by equation (2):

$$Q_{rad}=\epsilon\sigma A_{trim}F(T_{trim}^4-T_{amb}^4) \quad (2)$$

where

ϵ: emissive ~0.90;

σ: Stefan-Boltzmann constant $5.669\times10^{-8}$ (W/° $K.^4$-$m^2$); and

F: shape factor of ~0.95.

The same equations can be established for heatsink 14. In the example, heatsink 14 includes a thermally conductive material and has a plurality of fins having an effective surface area of approximately $A_{heatsink}$=0.065 $m^2$.

Convection heat transfer ($Q_{conv}$) for heatsink 14 is shown by equation (3):

$$Q_{conv}=\eta h A_{heatsink} dT \quad (3)$$

where

η: heatsink efficiency=η(heatsink base)×η(heatsink fins);

h: convection heat transfer coefficient (W/° C.-$m^2$), typical free convection coefficient=5;

dT: temperature difference from the heatsink base to the ambient air (° C.); and η=tan h mL/mL.

In equation (3), η=tan h mL/mL where $mL=(2*h/(k*t*L))^{1/2}*L^{3/2}$. Accordingly, $mL=(2\times5(20*23*2+52*\pi)/52*\pi)/(180\times0.005\times0.060))^{1/2}\times0.060^{3/2}$ or 0.52. Accordingly, η=tan h 0.52/0.52=0.91.

Radiation heat transfer for heatsink 14 is shown by equation (4):

$$Q_{rad}=\epsilon\sigma A_{heatsink} F (T_{heatsink}^4-T_{amb}^4) \quad (4)$$

where

ϵ: emissive ~0.30;

σ: Stefan-Boltzmann constant $5.669\times10^{-8}$ (W/° $K.^4$-$m^2$); and

F: shape factor of ~0.5.

Having determined the convection and radiation heat transfer equations for trim 12 and heatsink 14, it is possible to determine the energy balance of the system. The system includes trim 12, heatsink 14, and the LED light source that generates heat energy. The energy balance is given by equation (5):

$$Q_{led}=Q_{trim}+Q_{heatsink} \quad (5)$$

Assuming worst case conditions, the energy generated by an LED light source ($Q_{led}$) is approximately 15 watts. The ambient temperature of heatsink 14 ($T_{heatsink}$) deposited within a fully-insulated recessed can housing is approximately 50° C. The ambient temperature of trim 12 ($T_{trim}$) residing outside the recessed can housing is approximately 35° C. The ambient temperature of the room ($T_{amb}$) is approximately 25° C. Given these conditions, it is possible to determine the energy stored in trim 12 and heatsink 14. The energy within trim 12 ($Q_{trim}$) is determined by equation (6):

$$Q_{trim}=Q_{conv}+Q_{radi} \quad (6)$$

With reference to equation (6), $Q_{trim}=\eta hA_{trim}dT+\epsilon\sigma A_{trim}F (T_{trim}^4-T_{amb}^4)$. $Q_{trim}=0.965\times5\times0.0296\times(T_{trim}-35)+0.95\times5.669\times10^{-8}\times0.0296\times0.9\times(T_{trim}^4-308^4)$. Accordingly, $Q_{trim}=(0.143\ T_{trim}-4.99)+(1.43\times10^{-9}\times T_{trim}^4-12.86)$.

The energy within heatsink 14 ($Q_{heatsink}$) is determined by equation (7):

$$Q_{heatsink}=Q_{conv}+Q_{radi} \quad (7)$$

With reference to equation (7), $Q_{heatsink}=\eta hA_{heatsink} dT+\epsilon\sigma A_{heatsink} F (T_{heatsink}^4-T_{amb}^4)$. $Q_{heatsink}=0.91\times0.065\times5\times(T_{heatsink}-50)+0.3\times5.669\times10^{-8}\times0.065\times0.5\times(T_{heatsink}^4-323^4)$. Accordingly, $Q_{heatsink}=0.295\ T_{heatsink}-14.78+5.527\times10^{-10}\ T_{heatsink}^4-6.01$.

Assuming the temperature of heatsink 14 is equal to the temperature of trim 12 ($T=T_{trim}=T_{heatsink}$), equations (6) and (7) can be combined to generate equation (8):

$$15=0.438T+1.983\times10^{-9}T^4-38.64 \quad (8)$$

Numerical analysis of equation (8) results in a value of T=~61° C.

With the energy balance for the system, it is possible to determine the amount of heat transfer from trim 12 and heatsink 14 into the ambient air surrounding fixture 10. The energy dissipated by trim 12 at approximately 64.1° C. is given by equation (9):

$$Q_{trim}=Q_{conv}+Q_{radi} \quad (9)$$

With reference to equation (9), $Q_{trim}=\eta h A_{trim} dT+\epsilon\sigma A_{trim} F (T_{trim}^4-T_{amb}^4)$. $Q_{trim}=(0.143\ T_{trim}-4.99)+(1.43\times10^{-9}\times$ $T_{trim}^4-12.86$). Accordingly, $Q_{trim}=9.78$ Watts. As such, trim 12 dissipates approximately 65% of the heat energy generated by the LED light source.

The energy dissipated by heatsink 14 at approximately 64.1° C. is given by equation (10):

$$Q_{trim}=Q_{conv}+Q_{radi} \quad (10)$$

With reference to equation (10), $Q_{heatsink}=\eta h\ A_{heatsink}\ dT+\epsilon\sigma A_{heatsink}\ F\ (T_{heatsink}^4-T_{amb}^4)$. $Q_{heatsink}=(0.295\ T_{heatsink}-14.78)+(5.527\times10^{-10}\ T_{heatsink}^4-6.01)$. Accordingly, in this example, $Q_{heatsink}=5.22$ Watts. As such, heatsink 14 dissipates approximately 35% of the heat energy generated by the LED light source.

As shown in the example, fixture 10 efficiently dissipates a majority of heat generated by the light source through trim 12 and outside of the recessed can housing. By doing so, fixture 10 minimizes heat build-up within the recessed can housing and mitigates the deleterious effects of heat on the light source of fixture 10.

Trim 12 includes a thermally conductive material such as aluminum, aluminum alloys, copper, thermally conductive plastics, or thermally conductive carbon fiber composite material. Trim 12 is formed using a one-piece stamping manufacturing process, however other processes such as die casting, deep draw stamping, and those that combine multiple pieces to form trim 12 may be used. Trim 12 includes an outer flange portion and a light source attachment point. The outer flange protrudes from fixture 10 and, after installation of fixture 10, may contact a ceiling or wall surface. Depending upon the application, the flange portion of trim 12 may include features such as grooves and beveled edges that increase the surface area of trim 12 and allow it to dissipate heat energy more efficiently. Trim 12 may also be painted with a thermally conductive material, or include other surface decorations.

Trim 12 includes a light source attachment point located inwardly from the flange. The attachment point provides a mount point for physically mounting the light source to trim 12. The attachment point may include features such as openings or recesses to facilitate the formation of an electrical connection between socket 16 and the light source. For example, the attachment point includes one or more holes through which electrical wiring passes, see FIGS. 4*a* and 4*b*. As the light source generates heat, the heat is transferred into trim 12 at the attachment point. From there, the heat is transferred into both the flange of trim 12 and into heatsink 14.

Figure 4A:
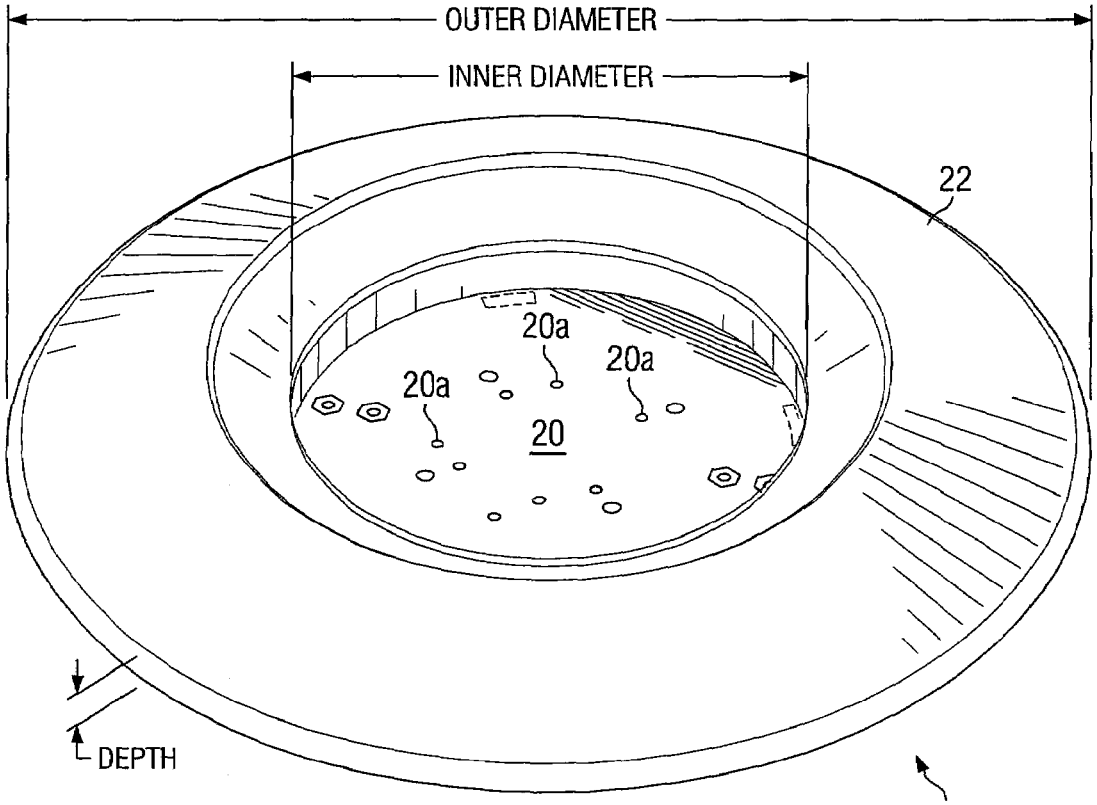
FIGS. 4*a*-4*b* illustrate perspective views of the thermally conductive trim section of the light fixture of FIGS. 2*a*-2*b* illustrating the heatsink and light source attachment points.
Figure 4B:
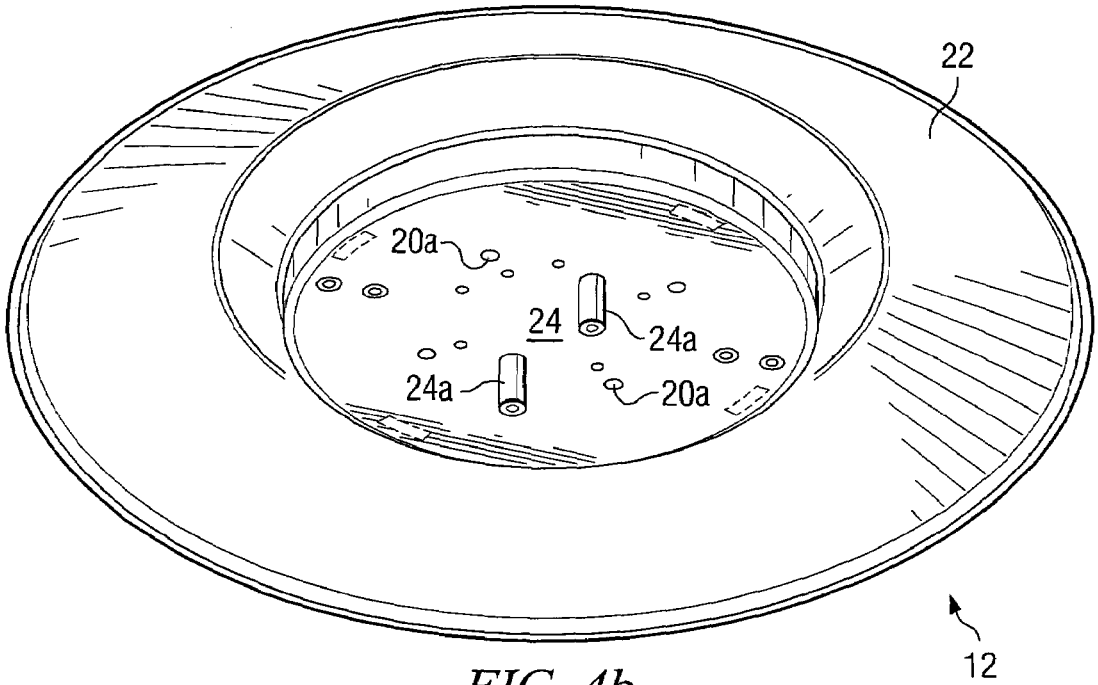

FIGS. 4*a* and 4*b* illustrate an embodiment of trim 12. In FIG. 4*a* a front surface of trim 12 is shown. Trim 12 is manufactured as a single piece of stamped aluminum and includes a central attachment area 20. Attachment point 20 serves as a mount point for the light source. The light source is connected to attachment area 20 of trim 12 using a plurality of screws or other fasteners. A thermally conductive material such as thermal grease or phase change thermally conductive pad is deposited over attachment area 20 between the light source and trim 12 to facilitate the efficient conduction of heat energy from the light source to trim 12. A plurality of holes 20*a* are formed close to attachment area 20 through which wires can pass to electrically connect the light source to socket 16 and an electricity source. A seal or grommet may be placed within holes 20*a* around the wires to prevent air flow through holes 20*a*. Trim 12 includes flange 22. After installation of fixture 10 into a recessed can housing, flange 22 projects from the housing and the front surface of trim 12 faces away from an interior portion of the recessed can housing. Accordingly, as heat energy enters trim 12 and moves to flange 22, flange 22 dissipates the heat from fixture 10 outside the recessed can housing into a room or office rather than into the housing itself.

Turning to FIG. 4*b*, a rear surface of trim 12 is shown. Trim 12 includes heatsink attachment point 24. Heatsink attachment point 24 includes a plurality of fixture points 24*a* for connecting heatsink 14 to trim 12 and is located approximately opposite light source attachment area 20. A thermally conductive material is deposited between trim 12 and heatsink 14 to facilitate the transfer of heat. Accordingly, after installation, the central portion of trim 12 is disposed between the light source and heatsink 14.

Referring back to FIG. 2, lens 23 is mounted over the light source attachment point of trim 12 and provides a portal through which light generated by the light source is transmitted from fixture 10. Lens 23 is attached to trim 12 using a friction coupling, adhesive, or a fastener such as a clip or screw. Lens 23 includes a substantially transparent material such as glass or clear plastic. In one embodiment, lens 23 includes poly-carbonate material. Lens 23 may include one or more optical features that alter light passing through lens 23 to provide a desired optical effect. For example, lens 23 may be translucent or frosty and may include polarizing filters, colored filters or additional lenses such as concave, convex, planar, "bubble", and Fresnel lenses. If the light source generates light having a plurality of distinct colors, for example, lens 23 may be configured to diffuse the light to provide sufficient color blending.

Heatsink 14 includes a thermally conductive material such as those used to fabricate trim 12 and is formed using an extrusion, die casting or stamping process. Heatsink 14 includes a plurality of fin structures to facilitate dissipation of heat energy collected within heatsink 14 into the surrounding air. Heatsink 14 is mechanically connected to trim 12 to provide for transfer of heat energy from trim 12 to heatsink 14. In one embodiment, heatsink 14 is connected to trim 12 with a plurality of fasteners such as screws or bolts. A thermally conductive material such as thermal grease, a thermally conductive pad, or a thermal epoxy is deposited between heatsink 14 and trim 12 to enhance the thermal connection between the two structures. The thermal grease may include a ceramic, carbon or metal-based thermal grease.

Light source 15 is connected to trim 12 and acts as a light source for fixture 10. To facilitate transmission of thermal energy from light source 15 to the attachment area of trim 12, a layer of thermally conductive material is deposited between light source 15 and trim 12. The thermally conductive material may include thermal grease, epoxy, a thermal interface pad, or a phase change thermally conductive material. In various embodiments, the light source may include conventional incandescent light bulbs, light emitting diodes (LEDs), light engines or other light sources. In one embodiment, the light source is a light engine that includes a plurality of LEDs. The plurality of LEDs are electrically interconnected and a single electrical input into the light engine is used to power each of the LEDs. Any class of LED device may be used in the light engine, including individual die, chip-scale packages, conventional packages, and surface mounted devices (SMD). The LED devices are manufactured using semiconductor materials, including, for example, GaAsP, GaP, AlGaAs, AlGaInP, GaInN, or the like. In one installation, the light engine includes a single printed circuit board (PCB) having a plurality of connected LEDs. The LEDs are electrically interconnected using PCB traces or wirebonds so that when a supply voltage is applied to the light engine, each of the LEDs is activated and outputs light.

In the light engine, each of the individual LEDs have a particular color output corresponding to particular wavelengths. The various output colors of each of the LEDs combine together to form an output color for the entire light engine device. Accordingly, by selecting multiple LEDs of various colors to be combined into the light engine, the overall output color of the engine can be controlled. In one embodiment, the selected combination of LED devices includes x red LEDs, y green LEDs, and z blue LEDs, wherein the ratio x:y:z is selected to achieve a particular white light correlated color temperature (CCT) having a temperature of approximately 2700K, 3000K, or 3500K. In a further alternative embodiment, the light engine includes a plurality of red, green, blue and amber LEDs.

In general, any number of LED colors may be used in any desirable ratio. A typical incandescent light bulb produces light with a CCT of 2700K (warm white light), and a fluorescent bulb produces light with a CCT of about 5000K. Thus, more red and yellow LEDs will typically be necessary to achieve 2700K light, while more blue LEDs will be necessary for 5000K light. To achieve a high color rendering index (CRI), a light source must emit white light with a spectrum covering nearly the entire range of visible light (380 nm to 770 nm wavelengths), such that dark red, light red, amber, light green, dark green, light blue and deep blue should be placed in the mix. In one embodiment, for example, the mixing ratio (with respect to number of LEDs) of R (620 nm):Y (590 nm):G (525 nm):B (465 nm) is 6:2:5:1 to achieve 3200K light. A R:Y:G:B mixing ratio of 7:3:7:2 may be used to achieve 3900K light. In yet another embodiment, a ratio of 10:3:10:4 is used to achieve 5000K light. In addition to white light, fixture 10 may incorporate light engines that generate non-white colors of light using similar color blending techniques. In some embodiments, the light engine includes two or more colors of LEDs that are combined to form a composite output color.

In addition to the use of RAGB or RGB LEDs to emit white light, other combinations of LEDs may be used. For example, the light engine may include blue LEDs coated with phosphor or uV LEDs coated with phosphor.

Figure 1:
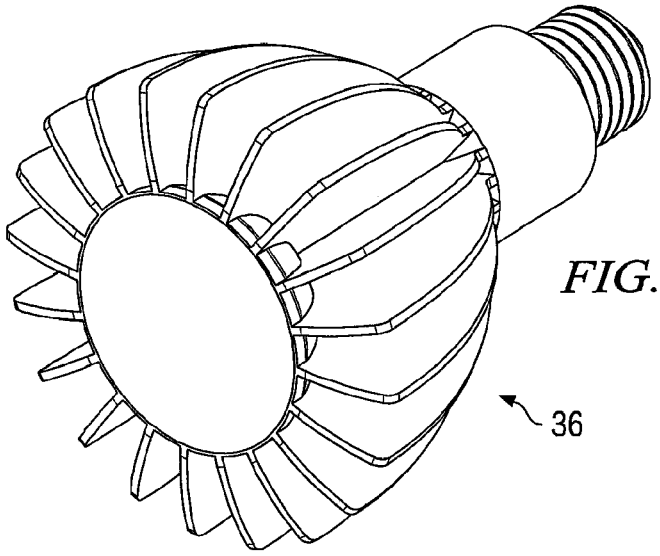
FIG. 1 illustrates a light emitting diode (LED)-based light source incorporating a plurality of heatsink fins and operating as a parabolic aluminized reflector (PAR) light source.
Figure 5:
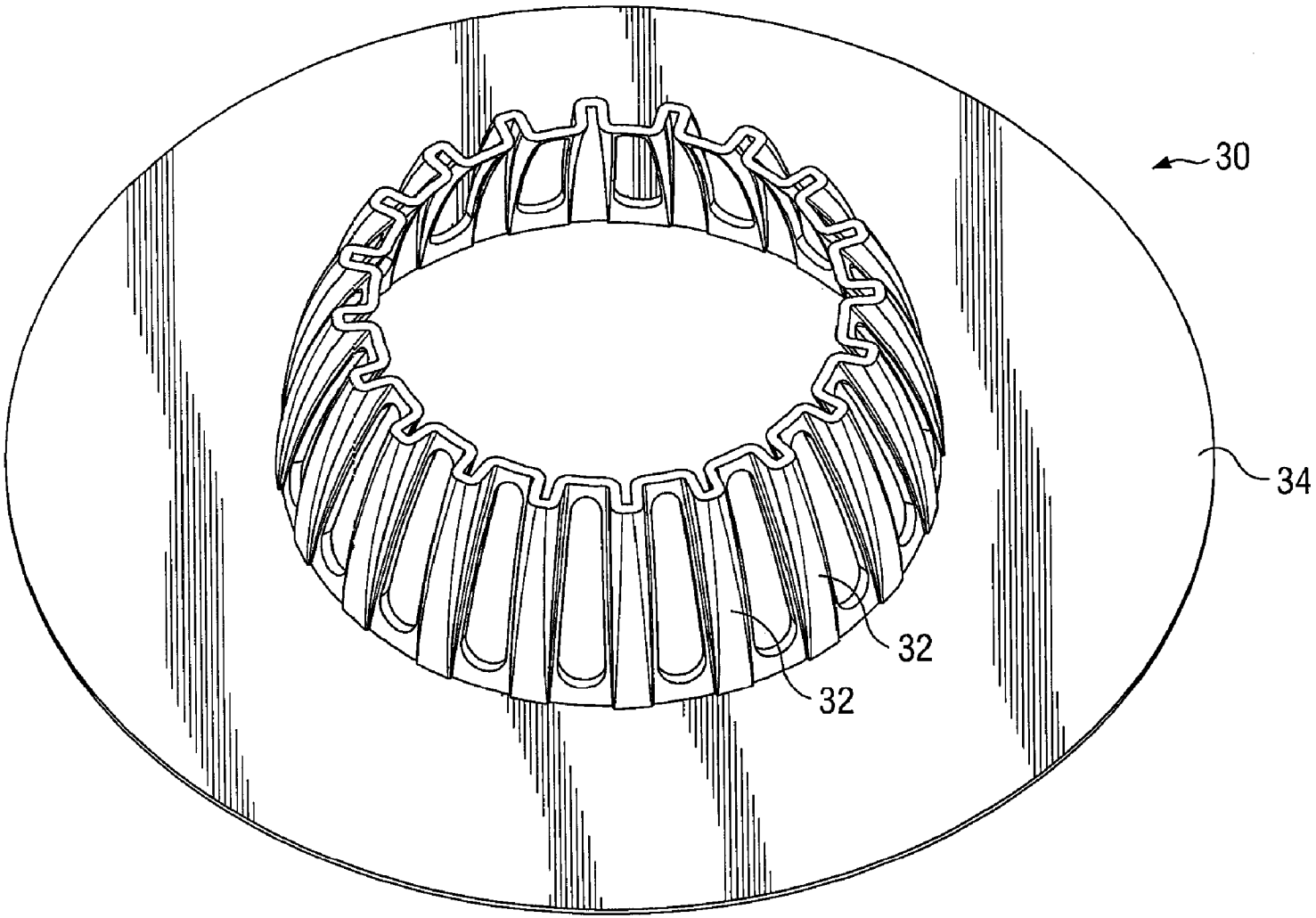
FIG. 5 is a perspective view of a thermally conductive trim section configured to connect to the light source shown in FIG. 1.
Figure 6B:
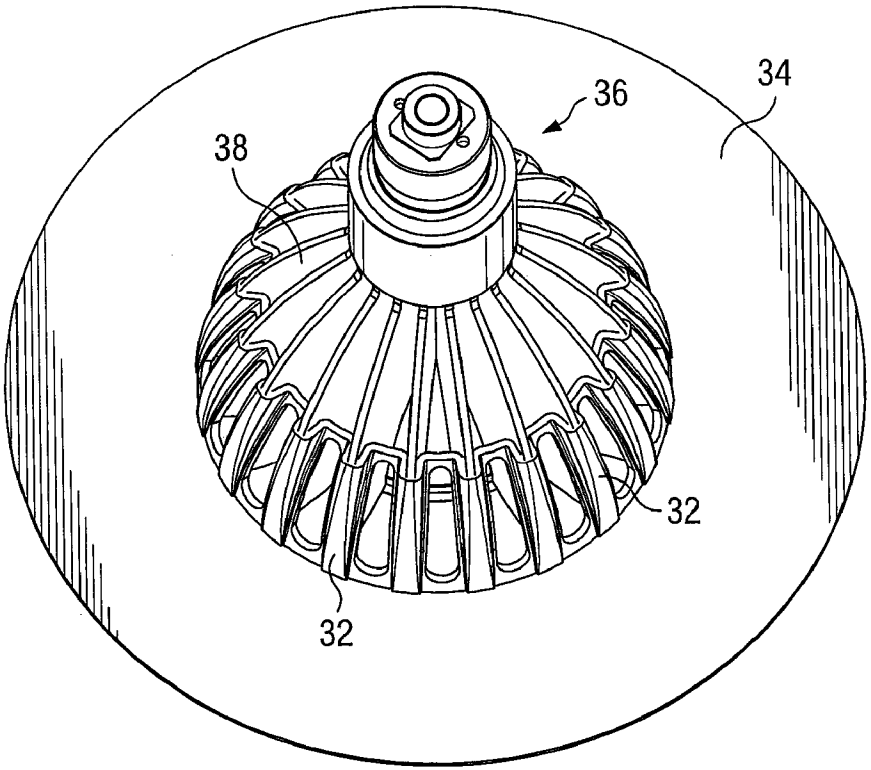
FIGS. 6*a*-6*b* illustrate perspective views of the thermally conductive trim of FIG. 5 coupled to the light source of FIG. 1 having an E26/E27 electrical socket.
Figure 6A:
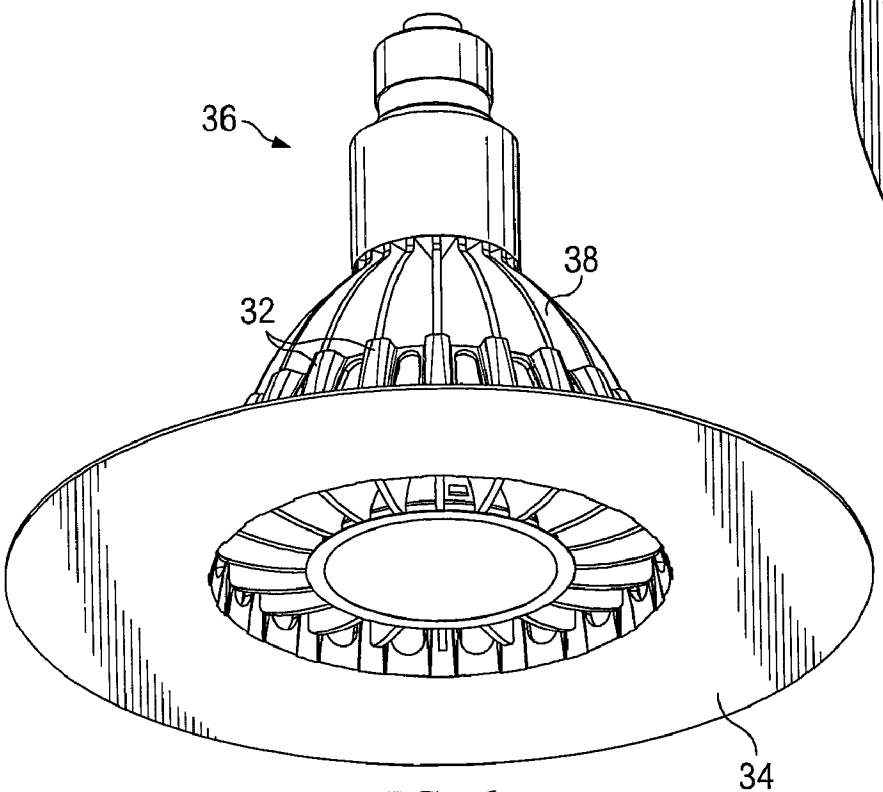
Figure 7B:
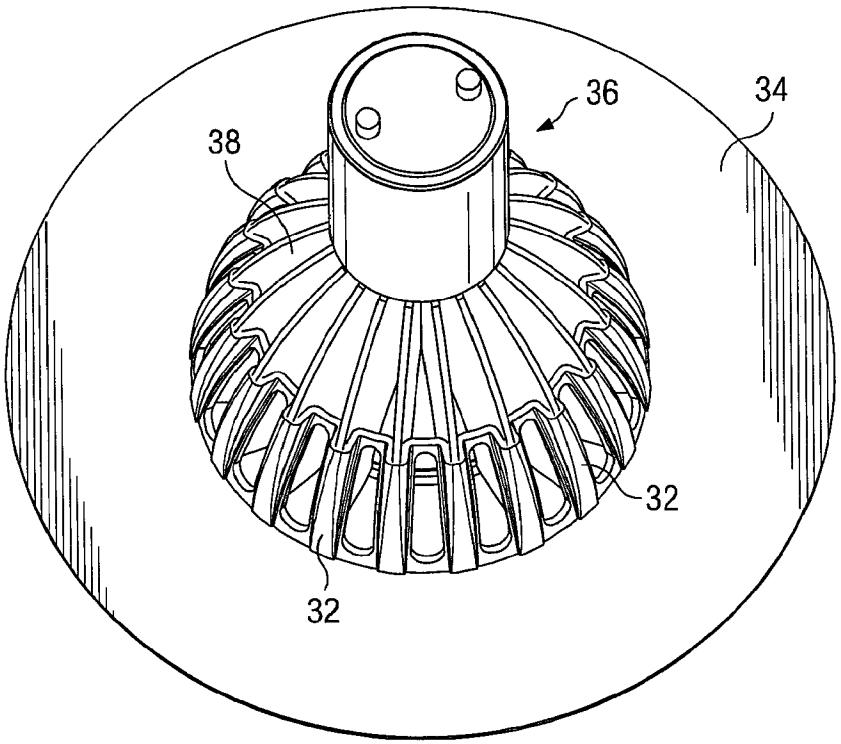
FIGS. 7*a*-7*b* illustrate perspective views of the thermally conductive trim of FIG. 5 coupled to the light source of FIG. 1 having a GU24 electrical socket.
Figure 7A:
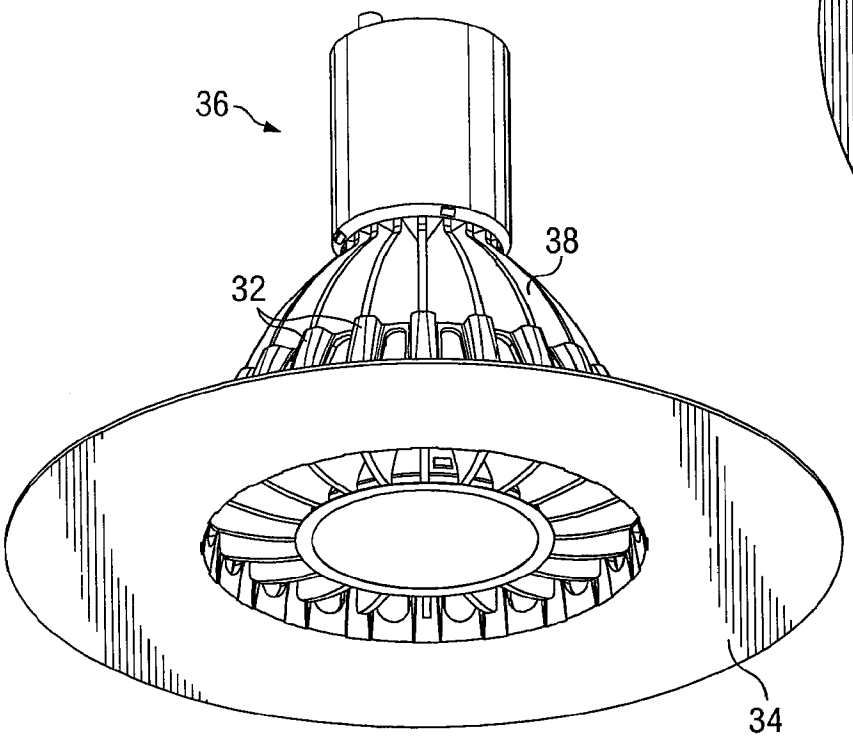

FIG. 5 illustrates a recessed can trim that may be coupled to a light source, the light source integrates a heatsink. Trim 30 includes a plurality of louvers 32 that are connected to flange 34. As shown in FIGS. 6*a* and 6*b*, trim 30 is connected to light source 36 (as shown in FIG. 1) having attached heatsink 38. In FIGS. 6*a* and 6*b*, light source 36 includes an E26/E27 style electrical socket. Louvers 32 of trim 30 are coupled via friction, adhesive or another fixture mechanism to the fins of heatsink 38. A thermally conductive material may be deposited between louvers 32 and the fins of heatsink 38. Due to their mechanical connection, as heat energy is created by the light source, it is transmitted into heatsink 38. From there, the heat energy is transmitted into the fins of heatsink 38 and, eventually, into louvers 32 of trim 30. As trim 30 absorbs heat energy from heatsink 38 via louvers 32, it is dissipated from trim 30 via flange 34. The light source of FIGS. 6*a* and 6*b* includes a conventional e26/e27 light socket, however in alternative embodiments the light source includes other electrical sockets. FIGS. 7*a*-7*b* illustrates the device of FIGS. 6*a*-6*b* wherein light source 36 includes a GU24 style electrical socket.

Figure 8:
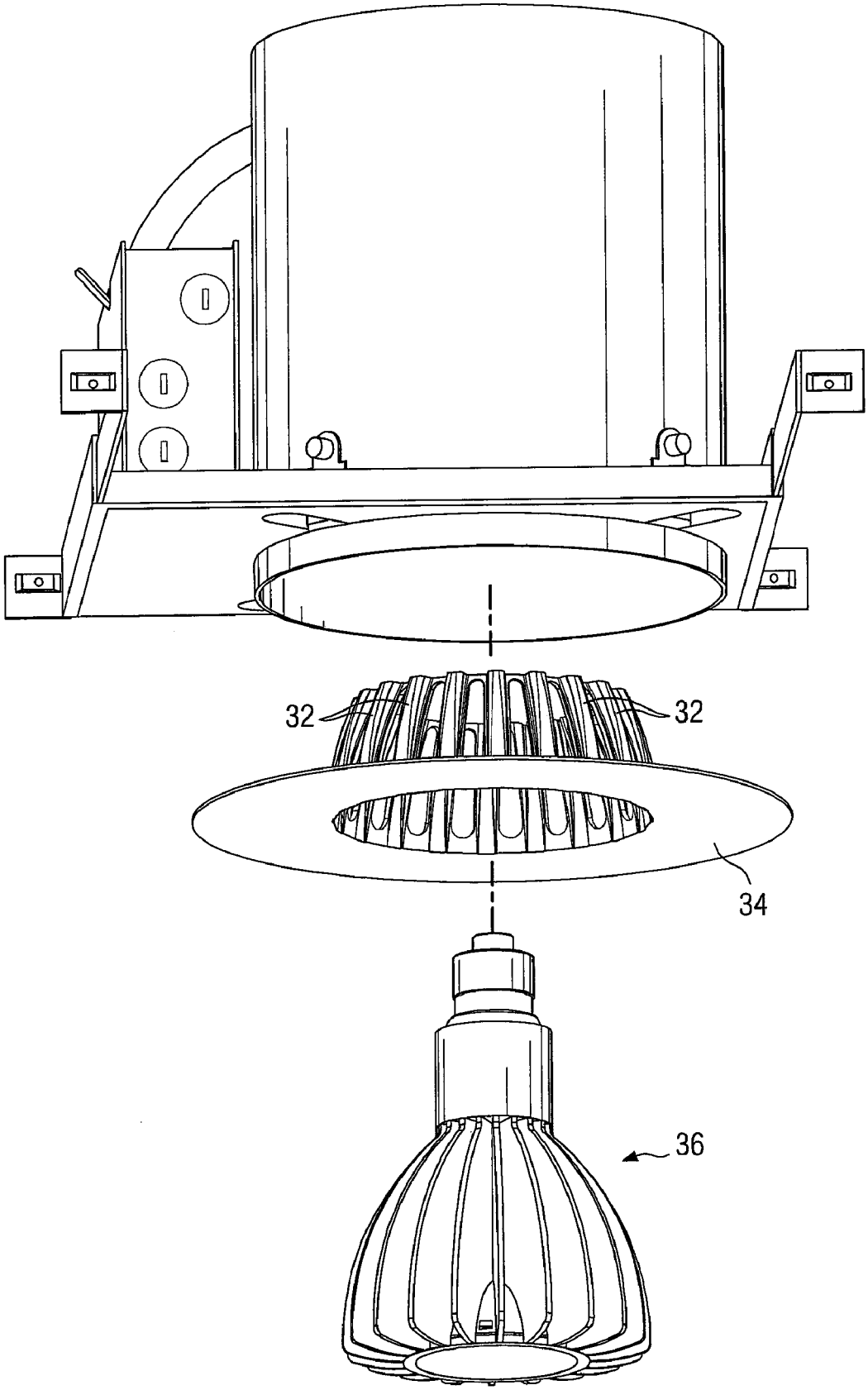
FIG. 8 is a perspective view illustrating the installation of the light fixture of FIGS. 6*a*-6*b* into a recessed can housing.

FIG. 8 illustrates a process for installing the fixture of FIGS. 6*a*-6*b* into a recessed can housing. The light source of FIG. 1 is installed into trim 30. Trim 30 is mounted within the recessed can housing a suitable attachment mechanism.

Figure 9A:
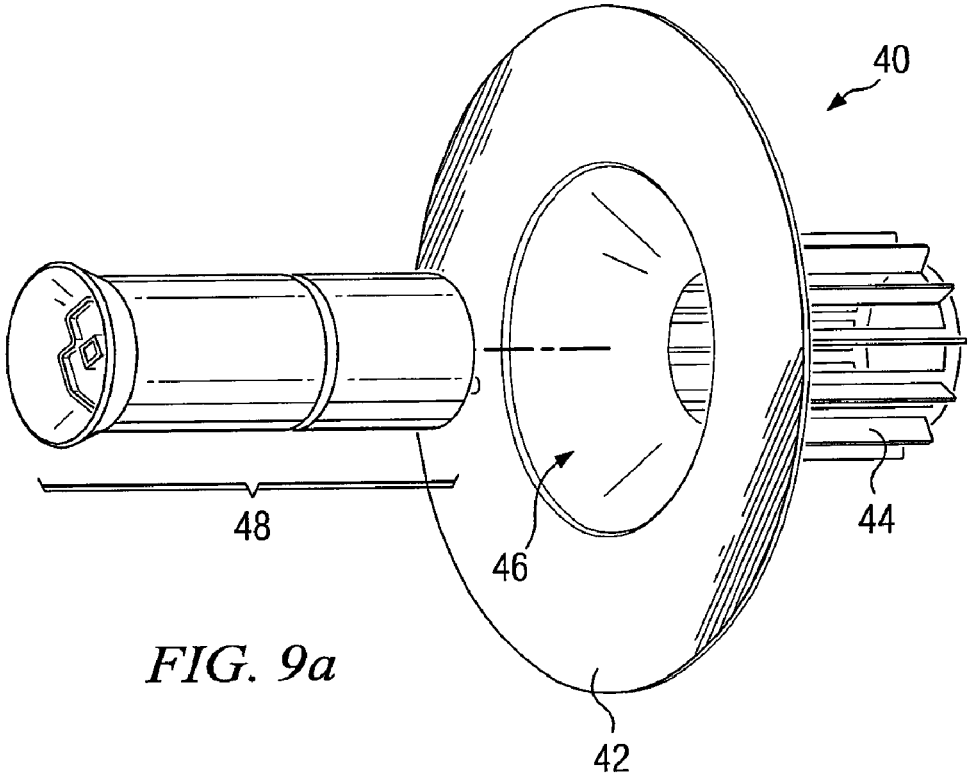
FIGS. 9*a*-9*b* are perspective views of a thermally conductive trim having an integrated heatsink and being configured to couple to a light source.
Figure 9B:
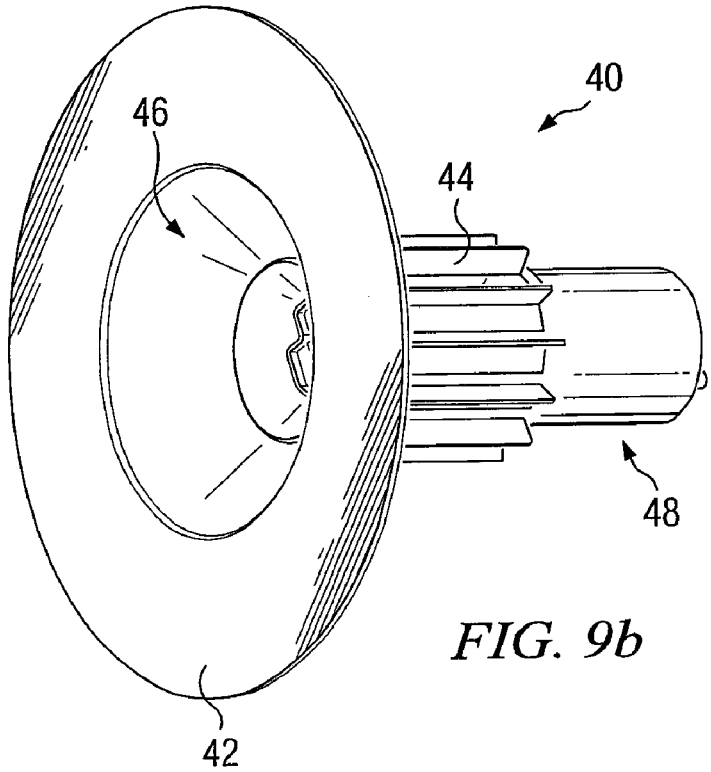

FIGS. 9*a* and 9*b* illustrate a thermally effective trim structure that includes a heatsink device. Trim 40 includes flange 42. Heatsink 44 is mounted to flange 42. Flange 42 and heatsink 44 may be formed as a single piece of material via an extrusion molding process, or may include separate pieces that are connected by a bonding process or by mechanical coupling. In one embodiment, flange 42 is connected to heatsink 44 using a plurality of fasteners. A thermally conductive material is deposited between flange 42 and heatsink 44. Trim 40 includes opening 46 that is configured to receive light source 48. Light source 48 includes an LED lamp, however other light sources such as conventional light bulbs may be used. Light source 48 is inserted into opening 46 (see FIG. 9*b*), and an outer surface of light source 48 contacts an inner surface of heatsink 44. As light source 48 generates heat energy, it is transmitted into heatsink 44 via the mechanical connection between light source 48 and heatsink 44. The mechanical connection may be enhanced by depositing a thermally conductive material between heatsink 44 and the outer surface of light source 48. As heatsink 44 absorbs energy from light source 48, some of the energy is dissipated via the fins of heatsink 44 and communicated to flange 42 from which it is also dissipated.

Figure 10A:
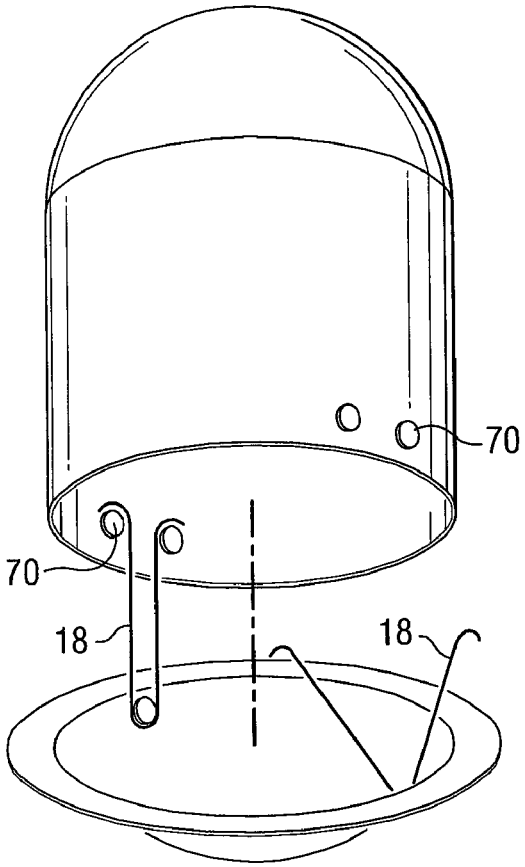
FIGS. 10*a*-10*d* illustrate perspective views of mechanisms for coupling a light fixture to an interior portion of a recessed can housing.
Figure 10B:
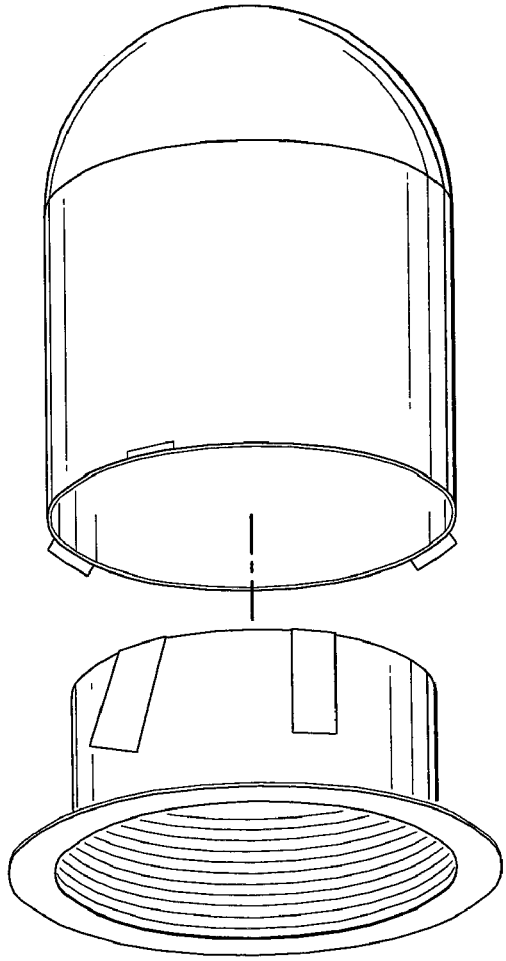
Figure 10C:
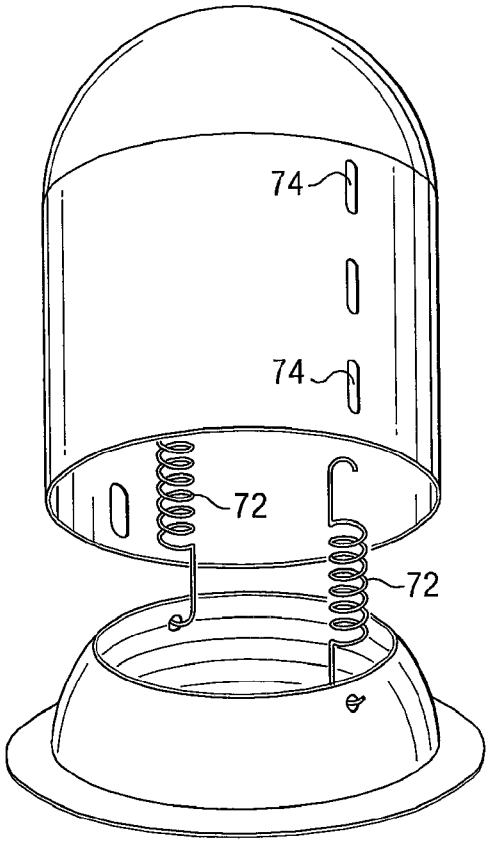
Figure 10D:
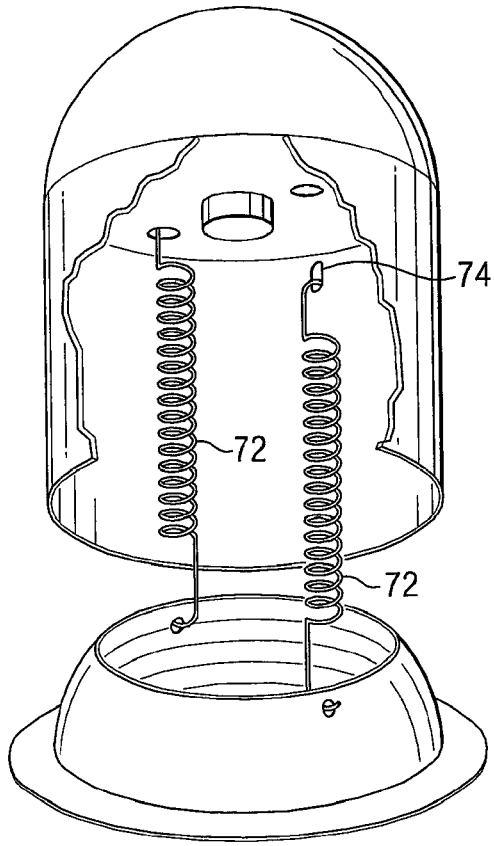

FIGS. 10*a*-10*d* illustrate a plurality of attachment mechanisms for connecting fixture 10 to a recessed can housing. FIG. 10*a* illustrates an attachment mechanism including torsion spring clips 18. As shown in FIG. 2*a*, clips 18 may be connected to trim 12 of fixture 10, however in other embodiments clips 18 may be connected anywhere on fixture 10. During installation of fixture 10, clips 18 are compressed to fit within the recessed housing. After fixture 10 is installed into the housing, clips 18 expand and an end portion of clips 18 contacts an interior surface or feature of the housing. As shown in FIG. 10*a*, clips 18 engage with slotted tabs 70. An end portion of clips 18 includes an elbow which further secures fixture 10 into the housing and prevents the fixture from falling out of the recessed housing. Depending upon the installation, spacer brackets may be installed between clips 18 and the body of fixture 10 ensuring clips 18 are in the correct location for coupling to the housing. For example, if fixture 10 is to be installed into a 15.24 cm or larger housing, additional spacer brackets may be installed to ensure that clips 18 are sufficiently far apart to couple to the clip connection points on the interior surface of the housing. In alternative embodiments, clips 18 may be replaced with other connection devices or mechanisms such as torsion springs, pressure springs, coil springs, or other fixture mechanisms. FIG. 10*b* illustrates fixture 10 including pressure springs. FIGS. 10*c*-10*d* illustrates fixture 10 including coil springs 72 as the attachment mechanism. A plurality of slots 74 formed in recessed can housing allow for adjustment of the placement and tension of coil springs 72 when fixture 10 is installed.

In one embodiment, the present invention is a method of manufacturing a lighting assembly comprising providing a light fixture by (a) forming a trim by a stamping or die casting process. The trim has thermally conductive properties and includes a flange around a perimeter of the trim. Providing the light fixture includes (b) mounting a light source to a central portion of a front surface of the trim, and (c) forming a heatsink by an extrusion, die casting, or stamping process. The heatsink has thermally conductive properties. Providing the light fixture includes (d) mounting the heatsink to a back surface of the trim opposite the light source, and (e) connecting an attachment mechanism, such as a torsion spring, to the light fixture. The method includes providing a recessed can housing mounted to a ceiling tile surface and mounting the light fixture to the recessed can housing by (f) inserting the heatsink into the recessed can housing, and (g) engaging the attachment mechanism to an interior portion of the recessed can housing to brace the flange against the ceiling tile surface.

In another embodiment, the present invention is a method of manufacturing a light fixture comprising forming a trim by a stamping process. The trim has thermally conductive properties and includes a flange around a perimeter of the trim. The method includes mounting a light source to a central portion of a front surface of the trim, and forming a heatsink by an extrusion process. The heatsink has thermally conductive properties. The method includes mounting the heatsink to a back surface of the trim opposite the light source, and connecting an attachment mechanism to the light fixture.

In another embodiment, the present invention is a method of manufacturing a light fixture comprising forming a trim including a flange around a perimeter of the trim, mounting a light source to a front surface of the trim, mounting a heatsink to a back surface of the trim, and connecting an attachment mechanism to the light fixture.

In another embodiment, the present invention is a light fixture comprising a trim formed by a stamping process. The trim has thermally conductive properties and includes a flange around a perimeter of the trim. The light fixture includes a light source mounted to a central portion of a front surface of the trim, and a heatsink mounted to a back surface of the trim opposite the light source. The heatsink is formed by an extrusion process and has thermally conductive properties. The light fixture includes an attachment mechanism connected to the light fixture.

While one or more embodiments of the present invention have been illustrated in detail, the skilled artisan will appreciate that modifications and adaptations to those embodiments may be made without departing from the scope of the present invention as set forth in the following claims.

What is claimed is:

1. A method of manufacturing a lighting assembly, comprising:

providing a light fixture by, (a) forming a trim by a stamping or die casting process, the trim having thermally conductive properties and including a flange around a perimeter of the trim, (b) mounting a light source to a central portion of a front surface of the trim, (c) forming a heatsink by an extrusion or die casting process, the heatsink having thermally conductive properties, (d) mounting the heatsink to a back surface of the trim opposite the light source, and (e) connecting an attachment mechanism to the light fixture;

providing a recessed can housing mounted to a surface; and mounting the light fixture to the recessed can housing by, (f) inserting the light fixture into the recessed can housing, and (g) engaging the attachment mechanism to an interior portion of the recessed can housing to brace the flange against the surface.

2. The method of claim 1, wherein the trim includes a metal, thermally conductive plastic or thermally conductive carbon fiber composite material.

3. The method of claim 1, wherein the light source includes a light engine having a plurality of light emitting diodes (LEDs)

4. The method of claim 3, wherein each of the plurality of LEDs has a color selected to achieve a target correlated color temperature.

5. The method of claim 3, wherein the light engine includes blue LEDs having a phosphor coating.

6. The method of claim 1, including mounting a lens to the trim over the light source, the lens including a clear, frosty or translucent glass or plastic material.

7. A method of manufacturing a light fixture, comprising:

forming a trim, the trim having thermally conductive properties and including a flange around a perimeter of the trim;

mounting a light source to a central portion of a front surface of the trim;

forming a heatsink, the heatsink having thermally conductive properties;

mounting the heatsink to a back surface of the trim opposite the light source; and connecting an attachment mechanism to the light fixture.

8. The method of claim 7, including:

providing a recessed can housing mounted to a surface; and mounting the light fixture to the recessed can housing by, (a) inserting the light fixture into the recessed can housing, and (b) engaging the attachment mechanism to an interior portion of the recessed can housing to brace the flange against the surface.

9. The method of claim 7, wherein the trim is formed using a stamping or die casting process.

10. The method of claim 7, wherein the heatsink is formed using an extrusion or die casting process.

11. The method of claim 7, wherein the trim includes aluminum, aluminum alloy, copper, copper alloy, thermally conductive plastic, or thermally conductive carbon fiber composite material.

12. The method of claim 7, wherein the light source includes a light engine having a plurality of light emitting diodes (LEDs)

13. The method of claim 12, wherein the light engine includes blue LEDs having a phosphor coating.

14. The method of claim 12, wherein each of the plurality of LEDs has a color selected to achieve a target correlated color temperature.

15. The method of claim 7, including mounting a lens to the trim over the light source, the lens including a clear, frosty or translucent glass or plastic material.

16. A light fixture, comprising:

a trim formed by a stamping or die casting process, the trim having thermally conductive properties and including a flange around a perimeter of the trim;

a light source mounted to a central portion of a front surface of the trim;

a heatsink mounted to a back surface of the trim opposite the light source, the heatsink being formed by an extrusion or die casting process and having thermally conductive properties; and an attachment mechanism connected to the light fixture.

17. The light fixture of claim 16, wherein the trim includes aluminum, aluminum alloy, copper, copper alloy, thermally conductive plastic, or thermally conductive carbon fiber composite material.

18. The light fixture of claim 16, wherein the light source includes a light engine having a plurality of light emitting diodes (LEDs)

19. The light fixture of claim 16, wherein the light engine includes blue LEDs having a phosphor coating.

* * * * *